US008505710B2

(12) United States Patent
Egerer

(10) Patent No.: US 8,505,710 B2
(45) Date of Patent: Aug. 13, 2013

(54) TRANSFER SYSTEM

(75) Inventor: Emil Egerer, Bubenreuth (DE)

(73) Assignee: Siemens Aktiengesellschaft, München (DE)

( * ) Notice: Subject to any disclaimer, the term of this patent is extended or adjusted under 35 U.S.C. 154(b) by 832 days.

(21) Appl. No.: 12/528,858

(22) PCT Filed: Feb. 22, 2008

(86) PCT No.: PCT/EP2008/052198

§ 371 (c)(1),
(2), (4) Date: Mar. 4, 2010

(87) PCT Pub. No.: WO2008/104514

PCT Pub. Date: Sep. 4, 2008

(65) Prior Publication Data

US 2010/0202866 A1 Aug. 12, 2010

(30) Foreign Application Priority Data

Feb. 28, 2007 (DE) ..... 10 2007 009 747

(51) Int. Cl.
*B65G 25/02* (2006.01)

(52) U.S. Cl.
USPC ..... 198/621.1; 198/468.2; 198/574; 198/596; 198/597; 198/750.11

(58) Field of Classification Search
USPC ..... 198/621.1, 621.2, 468.2, 574, 596, 198/597, 750.11
See application file for complete search history.

(56) References Cited

U.S. PATENT DOCUMENTS

| | | | | | |
|---|---|---|---|---|---|
| 3,757,961 | A * | 9/1973 | Jacobs | 198/621.1 |
| 3,907,098 | A | 9/1975 | Babbitt | |
| 4,166,527 | A * | 9/1979 | Beezer | 198/468.2 |
| 4,540,087 | A * | 9/1985 | Mizumoto | 198/621.1 |
| 4,557,657 | A * | 12/1985 | Olson et al. | 414/180 |
| 4,785,657 | A * | 11/1988 | Votava | 72/405.14 |
| 4,887,446 | A * | 12/1989 | Maher | 72/20.2 |
| 5,174,709 | A * | 12/1992 | Blatt et al. | 414/567 |
| 5,429,473 | A * | 7/1995 | Muller et al. | 198/468.6 |
| 5,452,787 | A * | 9/1995 | Ozawa | 198/468.4 |
| 5,562,196 | A * | 10/1996 | Zierpka et al. | 198/621.1 |
| 5,566,814 | A * | 10/1996 | Hofele | 198/621.1 |
| 6,193,049 | B1 * | 2/2001 | Noda | 198/346.2 |
| 6,336,548 | B1 * | 1/2002 | Asai et al. | 198/468.4 |
| 6,604,402 | B2 * | 8/2003 | Arai et al. | 72/405.13 |

(Continued)

FOREIGN PATENT DOCUMENTS

| | | | |
|---|---|---|---|
| DE | 1222759 | B | 8/1966 |
| DE | 3401704 | C1 | 4/1985 |
| DE | 102005019112 | A1 | 10/2006 |
| EP | 0728543 | A | 2/1996 |

(Continued)

OTHER PUBLICATIONS

Schuler, Handbuch der Umformtechnik, Schuler AG, 1996, pp. 230-242, Springer Verlag, Heidelberg.

*Primary Examiner* — Joseph A Dillon, Jr.

(57) ABSTRACT

In a transfer system, transport beams are displaced in three types of motions, i.e. toward each other, along a longitudinal extension thereof for advancement, and up and down. Two of these types of motions are triggered by a double-function motor. Such a double-function motor includes a shaft, which simultaneously rotates and displaces back and forth in linear fashion along the longitudinal extension thereof.

5 Claims, 2 Drawing Sheets

(56) References Cited

U.S. PATENT DOCUMENTS

| | | | | |
|---|---|---|---|---|
| 6,702,098 | B2 * | 3/2004 | Zeibig et al. | 198/468.2 |
| 7,189,049 | B1 * | 3/2007 | Blomgren et al. | 414/751.1 |
| 7,410,046 | B2 * | 8/2008 | Shiroza | 198/468.4 |
| 8,286,783 | B2 * | 10/2012 | Baba | 198/597 |
| 2007/0134082 | A1 * | 6/2007 | Blomgren et al. | 414/751.1 |
| 2011/0142584 | A1 * | 6/2011 | Wang | 414/520 |

FOREIGN PATENT DOCUMENTS

| | | | |
|---|---|---|---|
| JP | 54058284 | A | 5/1979 |
| JP | 4229063 | A | 8/1992 |
| JP | 5185164 | A | 7/1993 |
| JP | 2003290868 | A | 10/2003 |
| JP | 2005014071 | A | 1/2005 |
| WO | WO 03106069 | A | 12/2003 |

* cited by examiner

TRANSFER SYSTEM

CROSS REFERENCE TO RELATED APPLICATIONS

This application is the US National Stage of International Application No. PCT/EP2008/052198 filed Feb. 22, 2008, and claims the benefit thereof. The International Application claims the benefits of German Patent Application No. 10 2007 009 747.8 DE filed Feb. 28, 2007; both of the applications are incorporated by reference herein in their entirety.

FIELD OF INVENTION

The invention relates to a transfer system. Such a transfer system, frequently also known for short as a transfer, is provided in conjunction with an arrangement of multiple presses. The transfer system has the task of transporting one workpiece from one tool to the next within a press.

The transfer system here has two transport beams extending in a straight line, which can also be designated as gripper rails. The transport beams are parallel to each other. In a first type of motion they are too-free-moving to clamp a workpiece in position. In a second type of motion they can be moved along their longitudinal extension, in order to transport the fixedly clamped workpiece. As a rule, the longitudinal movement is vertically relative to the clamping movement. In a third type of motion, the transport beams can be lifted, in order to raise the fixedly clamped workpiece, which is in particular sensible within a press. The lift movement generally takes place in a direction which is vertical relative to the two other movement directions.

BACKGROUND OF INVENTION

Transfer systems of the type cited are for example described in detail in the book: Schuler, Handbuch der Umformtechnik, Schuler AG, Springer Verlag, Heidelberg, 1996, see in particular pages 230 to 242.

JP-A-2005014071 discloses a transfer system in which a motor drives a toothed wheel, by means of which a lifting and at the same time a lateral movement of a plate is performed.

FIG. 1 shows a three-dimensional view of a transfer system of the prior art, which is as a whole designated 10. The transfer system 10 is intended to transport workpieces between the tools of a press, which are not shown in the figure, and may be between a few meters and almost 100 m in length. To mount the transfer system 10 on the presses, an assembly structure 12 is arranged at one end of the transfer system, and an assembly structure 14 is arranged at the other end of the transfer system. At the heart of the transfer system are two transport beams 16. The transport beams 16 extend over the entire length of the transfer system 10. A movement of the transport beams 16 is effected by means of three different electric motors 18. It would basically be sufficient if three electric motors 18 were arranged on one side of the transfer system, but in the present instance, three electric motors 18 are in each case arranged on each side of the transfer system. One of the electric motors 18 on each side is responsible for a relative movement of the transport beams 16 towards each other corresponding to the arrow 20. By means of this relative movement 20, the transport beams can clamp a workpiece in place between them. A second of the electric motors 18 is responsible for a translatory movement along the longitudinal extension of the transport beams 16, see arrow 22. A third of the electric motors 18 on each side of the transfer system 10 is responsible for a lifting movement, see arrow 24.

The need to provide an electric motor in each case for each type of motion (arrows 20, 22 or 24), where the number of electric motors must even be doubled so that an electric motor effects the movement on both sides according to the type of motion, is a costly factor.

SUMMARY OF INVENTION

An object of the invention is thus to design a more compact transfer system.

The object is achieved in that the transfer system comprises a motor which is coupled to the transport beams in such a way that it effects movements of the transport beams according to two different types of motion of the three types of motion. This takes the form of a double-function motor, and this replaces two motors in the embodiment according to the prior art. The transfer system is thereby more compact.

A so-called combination drive can be used as a motor (cf. for example DE 10 2005 019 112 A1): such a motor has a (bar-type) shaft, which can simultaneously be rotated by the motor, and moved backwards and forwards in a linear manner along its longitudinal extension.

The rotary movement can then be responsible for a first type of motion of the transport beams, and the linear movement of the shaft can be responsible for a second type of motion of the transport beams.

It is basically not laid down for which type of motion the rotary movement of the motor and for which the translatory movement of the shaft of the motor can be responsible.

It has however proved not to be advantageous if translatory movement of the shaft of the motor is responsible for the second type of motion, because workpieces clamped in position may need to be transported over lengthy distances, while on the other hand there are limits on the translatory movement of the shaft.

The following four embodiments are therefore preferred:

According to a first embodiment, the rotary movement of the shaft of the motor is responsible for a movement of the transport beams corresponding to the third type of motion and the translatory movement of the shaft of the motor is responsible for a movement of the transport beams corresponding to the first type of motion.

In a second embodiment, the rotary movement of the shaft of the motor is responsible for a movement of the transport beams corresponding to the first type of motion and the translatory movement of the shaft of the motor is responsible for a movement of the transport beams corresponding to the third type of motion.

In a third embodiment, the rotary movement of the shaft of the motor is responsible for a movement of the transport beams corresponding to the second type of motion and the translatory movement of the shaft of the motor is responsible for a movement of the transport beams corresponding to the first type of motion.

In a fourth embodiment, the rotary movement of the shaft of the motor is responsible for a movement of the transport beams corresponding to the second type of motion and the translatory movement of the shaft of the motor is responsible for a movement of the transport beams corresponding to the third type of motion.

BRIEF DESCRIPTION OF THE DRAWINGS

A preferred embodiment of the invention is described below, with reference to the drawing, wherein.

DETAILED DESCRIPTION OF INVENTION

Figure 1:
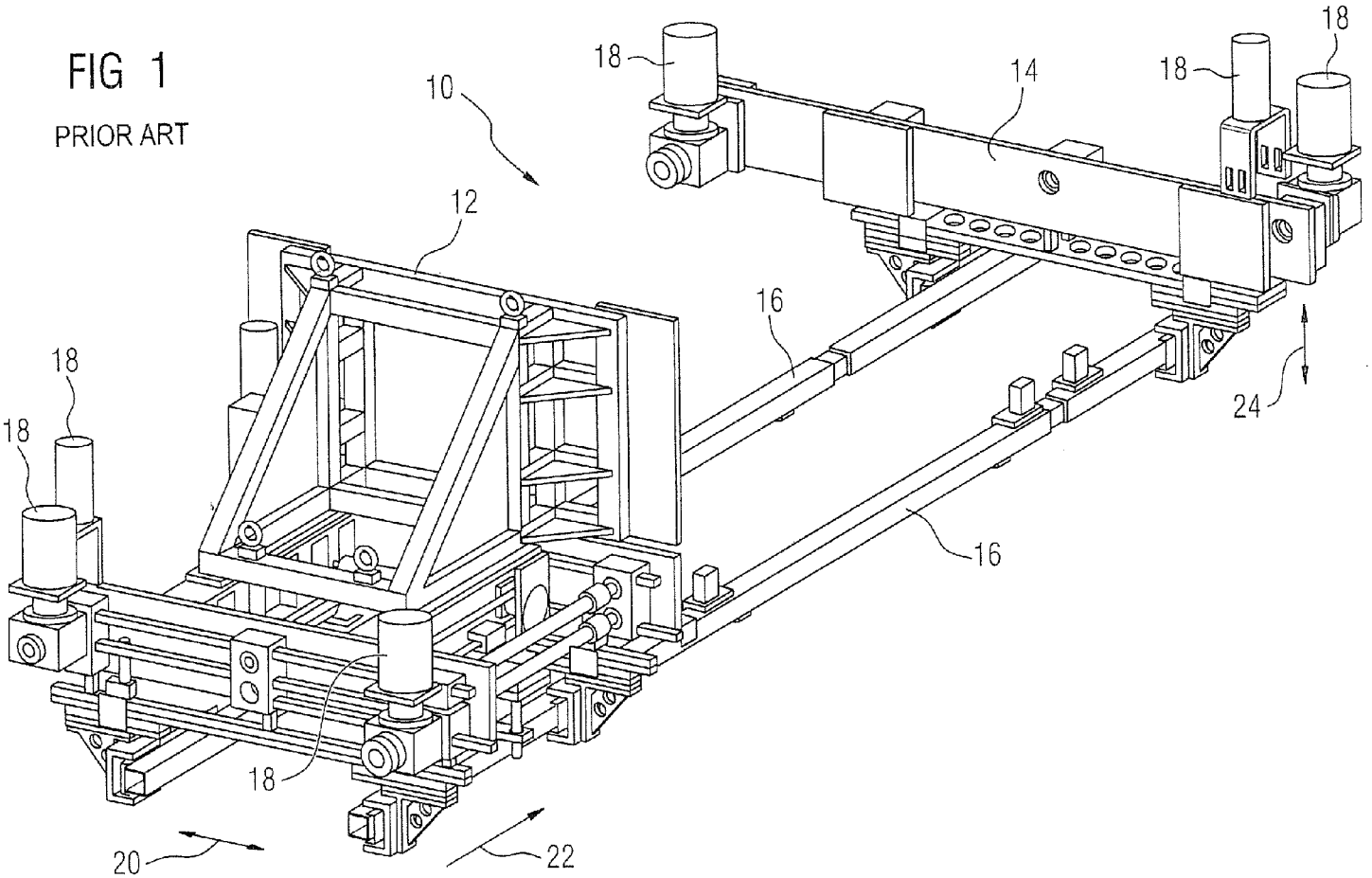
FIG 1 PRIOR ART
FIG. 1 shows a three-dimensional view of a transfer system according to the prior art and FIG. 2 shows a cross-sectional view of a transfer system according to the invention.
Figure 2:
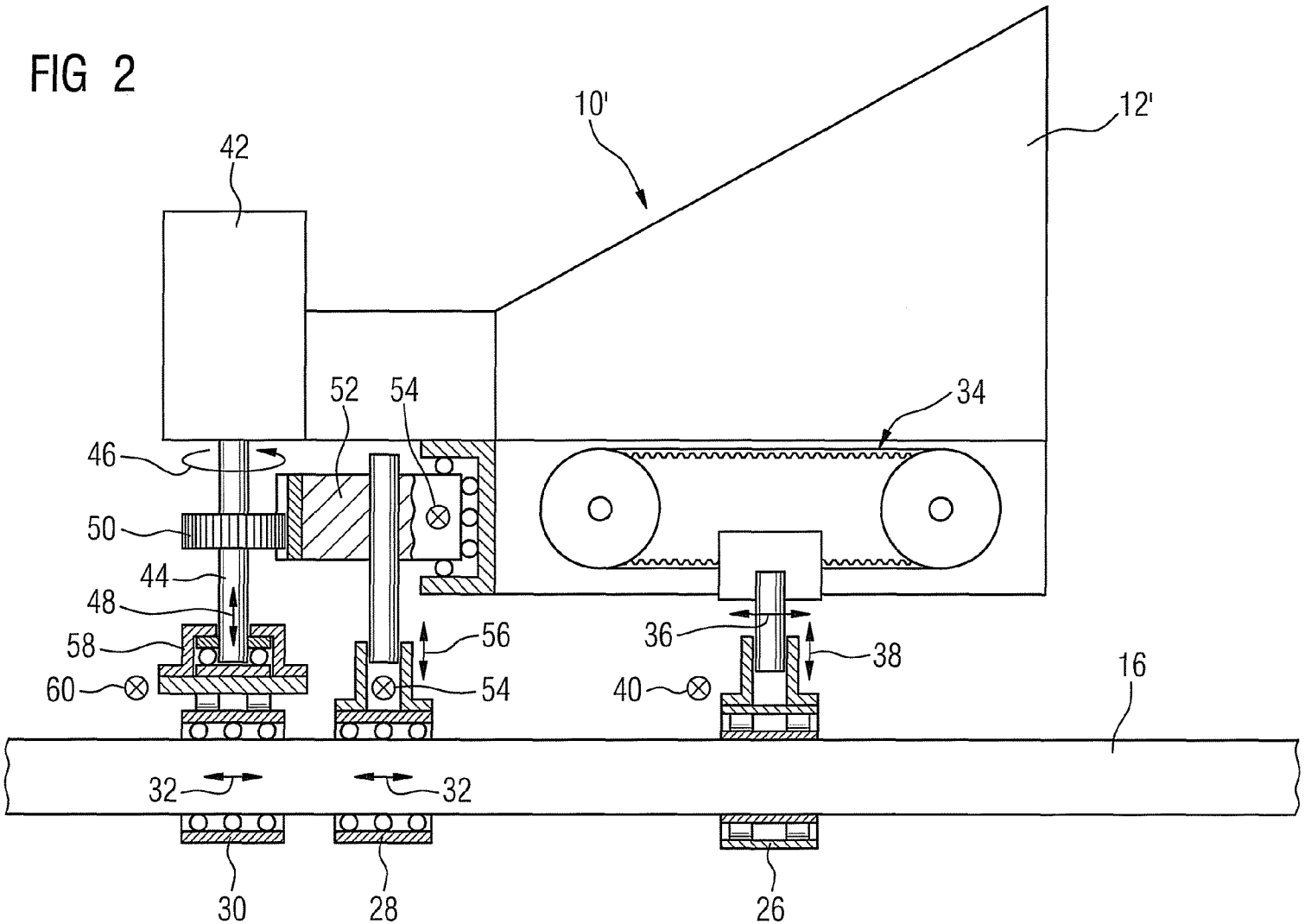

A transfer system 10', of which, compared with FIG. 1, FIG. 2 shows just one side with the assembly structure 12', comprises transport beams 16, which are to be moved in three directions in a mutually orthogonal manner. For each type of motion, a driver engages the transport beam 16, specifically one driver 26 for the advancement movement, one driver 28 for the transverse movement, in which the two transport beams 16 are moved towards, or as the case may be, away from each other, and one driver 30 for an upward or downward movement, for raising or lowering a workpiece. The driver 26 engages fixedly onto the transport beam 16, while the transport beam can be moved backwards and forwards 16 relative to the drivers 28 and 30, see arrows 32. These different functionalities of the drivers 28 and 30 compared with the driver 26 as regards advancement movement of the transport beam 16 are reflected in a different mounting of the transport beam 6 in the drivers. The movement of the driver 26 and thus the advancement movement of the transport beam 16 is effected via a toothed belt system 34. The toothed belt system 34 brings about a to and fro movement of driver 26 and transport beam 16 corresponding to the arrow 36. The driver 26 is movable relative to the toothed belt system 34 in both directions orthogonal to the advancement direction, see the arrow 38 for lifting and the rear view of arrow 40 for movement vertical to the plane of the paper.

The advancement movement thus takes place in an essentially conventional manner.

A single motor 42 is envisaged for movement of the two other drivers 28 and 30, which in the present case is a so-called combi drive: The motor 42 turns a shaft 44 corresponding to the arrow 46, and is simultaneously also capable of moving the shaft 44 up and down, see arrow 48. In order to convert the rotary movement of the shaft 44 into a translatory movement, a toothed wheel 50 is embodied on the shaft 44, which intermeshes with a gear rack 52. The rotation of the shaft 44 corresponding to the arrow 46 brings about a translatory movement of the gear rack 52, which in FIG. 2 takes place in a direction perpendicular to the plane of the paper, see arrow symbol 54. The gear rack 52 is coupled to the driver 28, so that its translatory movement accompanies a translatory movement of the transport beam 16. This movement causes the two transport beams 16 to approach each other, enabling them to grab a workpiece (cf. representation of the two transport beams 16 in FIG. 1: In the case of transport system 10', a second transport beam 16 is provided in a corresponding manner). The coupling of the driver 28 to the gear rack 52 is such as to enable an up and down movement of the driver 28 with an unchanged gear rack 52, see arrow 56.

This up and down movement can for its part occur if the motor 42 moves the shaft 44 to and fro corresponding to the arrow 48. The driver 30 is linked to the shaft 44 by means of a bracket 58. The bracket is embodied so as to enable a relative movement in the direction perpendicular to the plane of the paper corresponding to the arrow symbol 60. The mounting of the transport beam 16 in the driver 30 has already been mentioned above.

In the transfer system 10' it is the case that two types of motion, namely the transverse movement, movement of the transport beams 16 towards or away from each other, and the lifting movement, are effected by one and the same motor 42 (combi drive). In the case of the transfer system 10', the motor 42 thus replaces two of the electric motors 18 which the transfer system 10 of the prior art has. The further type of motion, in this case the advancement movement of the transport beams 16, is effected in the customary manner. Alternatively to the embodiment represented, it is also possible for the up and down movement to take place in an essentially conventional manner, and the rotary movement of the shaft of the combi drive to bring about the advancement movement.

As already mentioned, FIG. 2 shows just one side of the transfer system 10'. In the same way as the transfer system 10 of the prior art has three electric motors on both sides, the transfer system 10' can also have a double-function motor 42 on the second side.

The invention claimed is:

1. A transfer system, comprising:

a first assembly structure and a second assembly structure, two transport beams extending parallel to each other, side by side, and in a straight line between the first assembly structure and the second assembly structure, which, in a first type of motion, the two transport beams are moved towards each other in order to clamp a workpiece in position, which, in a second type of motion, the two transport beams are moved along their longitudinal extension in order to transport the fixedly clamped workpiece, and which, in a third type of motion, the two transport beams are raised in order to lift the fixedly clamped workpiece;

a double-function motor with a shaft, the double-function motor effective to impart any of: rotation about a shaft longitudinal axis; translation to and from along the shaft longitudinal axis; and the rotation and the translation simultaneously while each is individually controlled, and a second motor, wherein the double-function motor is secured to one of assembly structures and linked to at least one of the transport beams such that the double-function motor effects two different types of motion of the three types of motion, wherein the rotation of the shaft effects one of the two different types of motion via a gear arrangement between the shaft and at least one of the transport beams, and wherein the translation of the shaft effects another of the two different types of motion via a connection between the shaft and at least one of the transport beams, and wherein the second motor is secured to one of the assembly structures and connected to at least one of the transport beams such that the second motor effects a remaining type of motion of the three types of motion.

2. The transfer system as claimed in claim 1, wherein the rotary movement of the shaft of the double-function motor is responsible for a movement of the transport beams corresponding to a third type of motion and the translatory movement of the shaft of the double-function motor is responsible for a movement of the transport beams corresponding to the first type of motion.

3. The transfer system as claimed in claim 1, wherein the rotary movement of the shaft of the double-function motor is responsible for a movement of the transport beams corresponding to the first type of motion and the translatory movement of the shaft of the double-function motor is responsible for a movement of the transport beam corresponding to the third type of motion.

4. The transfer system as claimed in claim 1, wherein the rotary movement of the shaft of the double-function motor is responsible for a movement of the transport beams corresponding to the second type of motion the translatory movement of the shaft of the double-function motor is responsible for a movement of the transport beams corresponding to the first type of motion.

5. The transfer system as claimed in claim 1, wherein the rotary movement of the shaft of the double-function motor is responsible for a movement of the transport beams corresponding to the second type of motion and the translatory movement of the shaft of the double-function motor is responsible for a movement of the transport beams corresponding to the third type of motion.

* * * * *